United States Patent [19]

Sarno et al.

[11] Patent Number: 4,822,029

[45] Date of Patent: Apr. 18, 1989

[54] EXERCISER SIMULATOR HAVING A FRAME ROTATABLY MOUNTED ON A FULCRUM POINT

[76] Inventors: Gregory G. Sarno, 19070 Mayberry Dr., Castro Valley, Calif. 94546; Robert J. Williams, 626 Polk St., Apt. 505, San Francisco, Calif. 94102; Michael E. Hohmeyer, 2627 Ashby St., Berkeley, Calif. 94708

[21] Appl. No.: 106,720

[22] Filed: Oct. 8, 1987

Related U.S. Application Data

[62] Division of Ser. No. 810,181, Dec. 18, 1985, abandoned.

[51] Int. Cl.[4] ..... A63B 23/06

[52] U.S. Cl. ..... 272/69; 272/70; 272/132

[58] Field of Search ..... 272/69, 70, 70.2, 73, 272/131, 132; 182/37, 42, 43

[56] References Cited

U.S. PATENT DOCUMENTS

| | | | |
|---|---|---|---|
| 263,490 | 3/1882 | Hickman | D21/192 |
| 476,885 | 6/1892 | Loyd | 272/69 |
| 2,042,764 | 6/1936 | Birch | 272/69 |
| 3,497,215 | 2/1970 | Harrison et al. | 272/69 |
| 3,511,500 | 5/1970 | Dunn | 272/79 |
| 3,529,474 | 9/1970 | Olson et al. | 73/379 |
| 3,592,466 | 7/1971 | Parsons | 272/69 |
| 3,628,791 | 12/1971 | Garcia | 272/83 |
| 3,637,206 | 1/1972 | Chickering, III | 272/69 |
| 3,641,601 | 2/1972 | Sieg | 5/345 |
| 3,747,924 | 8/1978 | Champoux | 272/79 |
| 3,758,112 | 9/1978 | Crum et al. | 272/79 |
| 3,970,302 | 1/1976 | McFee | 272/130 |
| 3,995,491 | 12/1976 | Wolfla | 272/69 |
| 4,148,478 | 4/1979 | Moyski et al. | 272/73 |
| 4,204,673 | 5/1980 | Speer, Sr. | 272/69 |
| 4,279,415 | 7/1981 | Katz | 272/70 |
| 4,285,516 | 8/1981 | Heatwole | 272/146 |
| 4,340,218 | 7/1982 | Wilkinson | 272/136 |
| 4,376,532 | 3/1983 | Hunstad | 272/97 |
| 4,470,597 | 9/1984 | McFee | 272/128 |
| 4,496,147 | 3/1985 | DeCloux et al. | 272/130 |
| 4,501,421 | 5/1985 | Kane | 272/96 |
| 4,687,195 | 8/1987 | Potts | 272/69 |

*Primary Examiner*—Richard J. Apley
*Assistant Examiner*—J. Welsh
*Attorney, Agent, or Firm*—Limbach, Limbach & Sutton

[57] ABSTRACT

An exerciser simulator that comprises at least two generally concave members which define a frame, each of the concave members has a first end and a second end. In addition, a rotatable member is positioned adjacent to each of the first and second ends of each of the concave members. A unidirectional, close-looped transporting chain travelling adjacent to each of the concave members is provided, the transporting chain being rotatably received by the first end rotatable member and the second end rotatable member for travelling toward a direction defined by one of the first and second ends of each of the concave members. The exerciser simulator further comprises a plurality of exercise bars each of which is fixably mounted to both of the transporting chains, the exercise bars being mounted generally normal to the transporting chains at preselected positions of the transporting chains. Each of the exerise bars is securely mounted to the transporting chains, so that the weight of a user, as he advances on the exercise bars towards a direction opposite to the defined direction of travel of the transporting chains, causes the transporting chains and the attached exercise bars to travel toward the defined direction, thereby simulating a climbing exercise.

6 Claims, 17 Drawing Sheets

EXERCISER SIMULATOR HAVING A FRAME ROTATABLY MOUNTED ON A FULCRUM POINT

This is a divisional of application Ser. No. 810,181, filed Dec. 18, 1985, now abandoned.

DESCRIPTION

1. Technical Field

This invention relates to exercise apparatus, and more particularly, to an exerciser simulator.

2. Background Art

Exercising apparatus are common in the art. Due to the advent of health consciousness in recent years, exercising apparatus are in demand. In particular, apparatus which simulate an exercise that requires an inordinate amount of space such as jogging, climbing or other leg training exercises. Since these exercises generally require not only a large space such as a gymnasium but also exercising in an uncontrolled environment such as practice fields or streets, apparatus which simulate these exercises are necessary. Especially, simulators which are small and portable such that they may be used in exercise clinics or in homes.

Examples of prior art apparatus for simulating exercises, especially those simulating leg exercises, include apparatus disclosed in DeCloux et al., U.S. Pat. No. 4,496,147; Wilkinson, U.S. Pat. No. 4,340,218; McFee, U.S. Pat. No. 3,970,302; Parsons, U.S. Pat. No. 3,592,466; and Harrison et al., U.S. Pat. No. 3,497,215. These apparatus are generally deficient in several aspects. First, DeCloux et al., Wilkinson and McFee are essentially stationary exercising apparatus in which the user cannot simulate climbing or running up more than two steps. In addition, the user's hands and arms are generally not being exercised; his hands must hold onto handles or rails in order to maintain his balance on the apparatus. Next, the apparatus disclosed in Parsons and Harrison et al. are generally bulky and cumbersome, and utilize complex machinery. In addition, these apparatus can simulate only one type of exercise, i.e., the leg exercises. The users of these apparatus must also use their hands to securely balance themselves. They are incapable of simulating other types of exercises such as arm exercises.

DISCLOSURE OF THE INVENTION

It is a major object of the present invention to provide an exerciser simulator that is capable of simulating multiple exercises.

It is another object of the present invention to provide an exerciser simulator that is compact and portable.

It is a further object of the present invention to provide an exerciser simulator that is simple in design and easy to operate.

In order to accomplish the above and still further objects, the present invention provides an exerciser simulator that comprises at least two generally concave members which define a frame; each of the concave members has a first end and a second end. In addition, a rotatable member is positioned adjacent to each of the first and second ends of each of the concave members. A unidirectional, close-looped transporting chain travelling adjacent to each of the concave members is provided, the transporting chain being rotatably received by the first end rotatable member and the second end rotatable member for travelling toward a direction defined by one of the first and second ends of each of the concave members. The exerciser simulator further comprises a plurality of exercise bars each of which is fixably mounted to both of the transporting chains, the exercise bars being mounted generally normal to the transporting chains at preselected positions of the transporting chains. Moreover, each of the exercise bars has two mounting means for securely mounting each of the exercise bars to the transporting chains, whereby the weight of a user, as he advances on the exercise bars towards a direction opposite to the defined direction of travel of the transporting chains, causes the transporting chains and the attached exercise bars to travel toward the defined direction, thereby simulating a climbing exercise.

Other objects, features, and advantages of the present invention will appear from the following detailed description of the best mode of a preferred embodiment, taken together with the accompanying drawings.

BEST MODE FOR CARRYING OUT THE INVENTION

Figure 1:
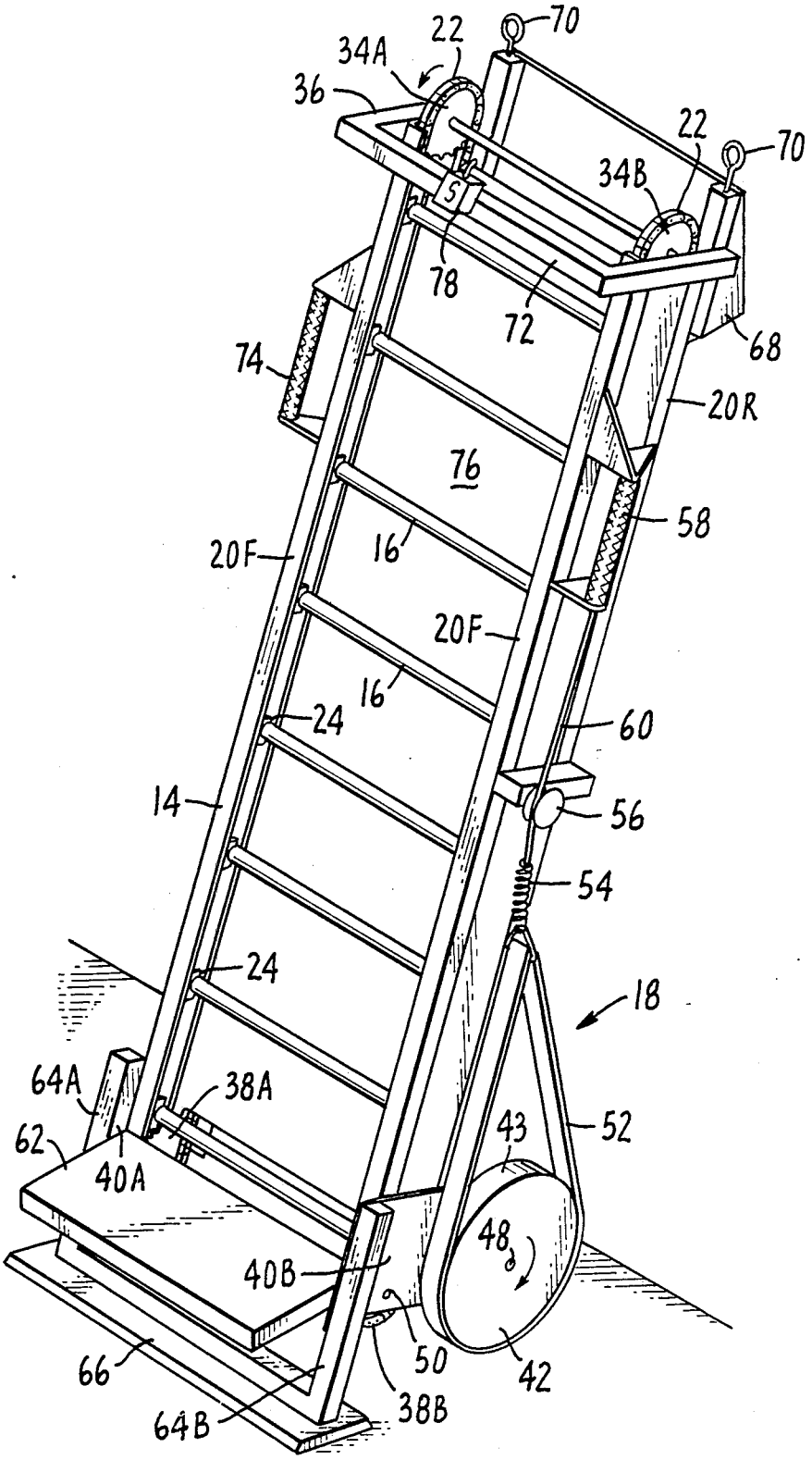
FIG. 1 is a perspective view of an exerciser simulator of the present invention, with portions broken away.
Figure 2:
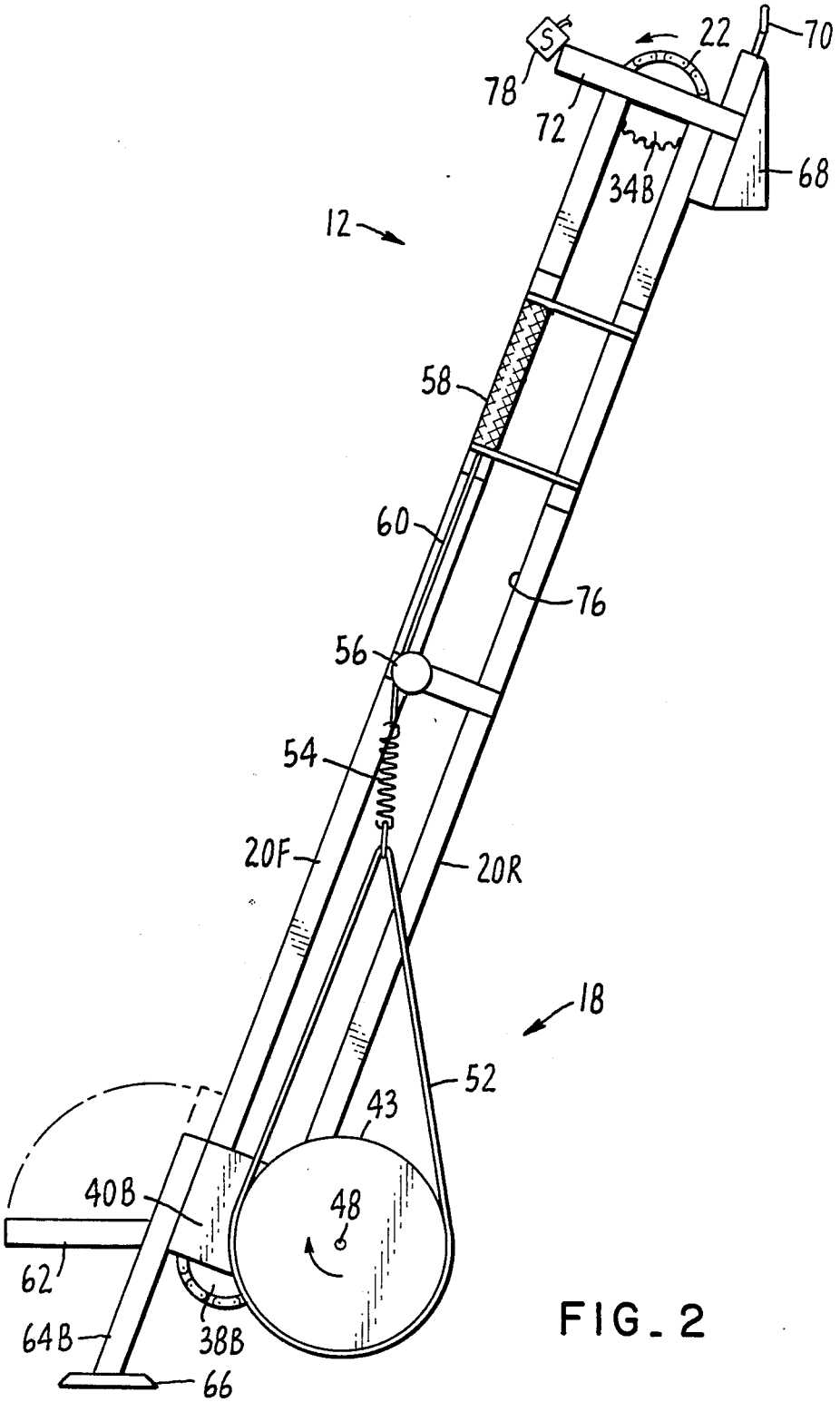
FIG. 2 is a side view of the exerciser simulator of FIG. 1, with portions broken away.
Figure 3:
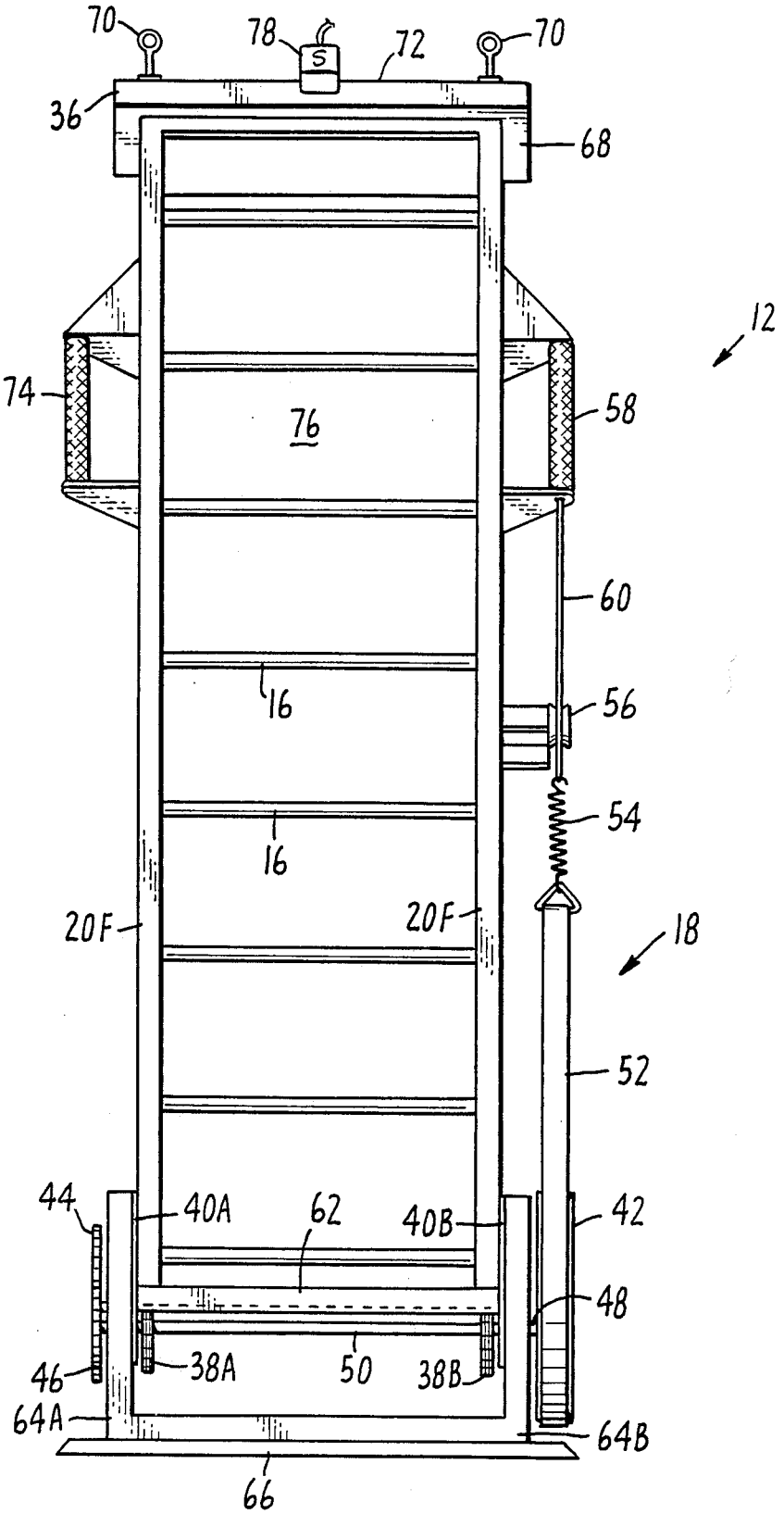
FIG. 3 is a front view of the exerciser simulator of FIG. 1, with portions broken away.

Referring to FIGS. 1–3, there is shown an apparatus for simulating climbing, designated 12. Apparatus or exerciser simulator 12 comprises a frame 14, a plurality of rungs 16 rotatably mounted onto frame 14, and a speed regulation means 18 for controlling the speed of the movement of rungs 16.

Figure 4:
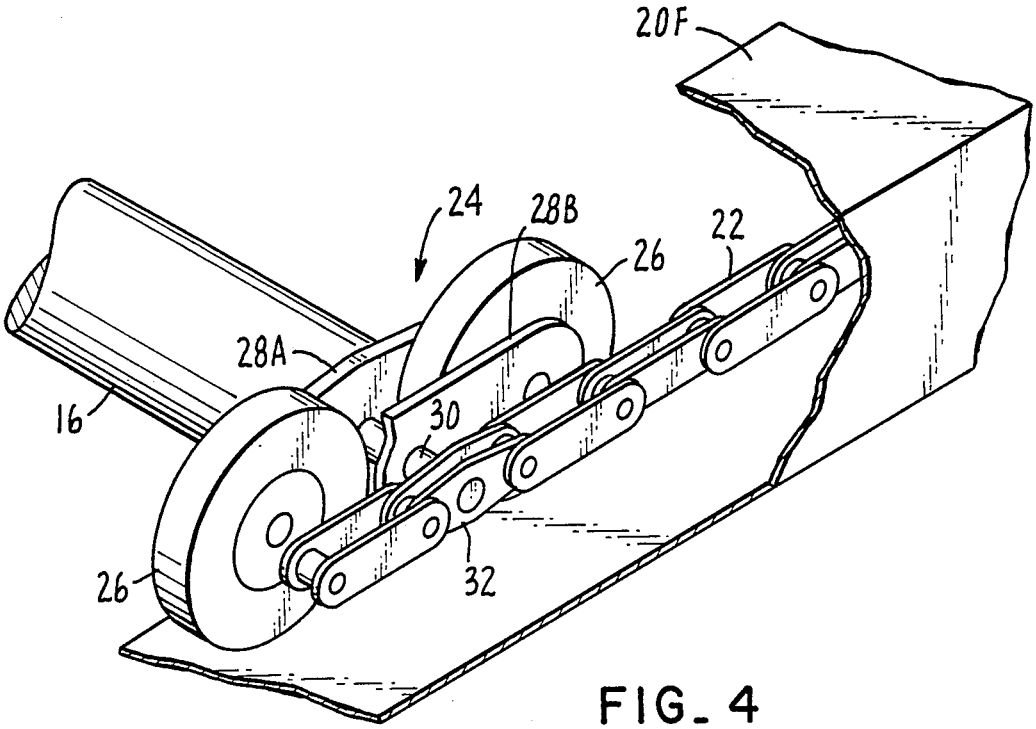
FIG. 4 is an enlarged, perspective view of the rung attachment means of the exerciser simulator of FIGS. 1–3, with portions broken away.

More particularly, frame 14 comprises four generally U-shaped brackets, the pair of forward brackets are designated 20F and the pair of rearward brackets are designated 20R. Positioned within each bracket is a close-looped transporting chain 22 that travels in a generally vertical direction. Positioned at predetermined locations on chain 22 are rung attachment means 24, as best shown in FIGS. 1 and 4. Chain 22 is a conventional chain link such as those used to propel bicycles.

Attachment means 24 includes a pair of wheels 26 which are rotatably mounted onto a pair of wheel or mounting plates 28A and 28B. Rung 16 is fixably mounted onto wheel plates 28A and 28B, which are in turn fixably mounted onto chain 22. Rung 16 and plates 28A and 28B are mounted onto chain 22 by shaft 30. In addition, shaft 30 is fixably mounted onto an adaptive chain link 32, as best shown in FIG. 4. Attachment means 24, especially wheel 26, travel within front brackets 20F and rear brackets 20R. As best shown in FIG. 1, rung attachment means 24 are positioned such that each rung 16 travels in a manner that is normal to chain 22.

Exerciser simulator 12 also comprises a pair of upper sprockets 34A and 34B, as best shown in FIGS. 1 and 2. Sprockets 34 are rotatably mounted onto upper bracket 36 which in turn is mounted onto brackets 20F and 20R. Each of upper sprockets 34A and 34B is adapted to receive a chain 22. Moreover, exerciser simulator 12 comprises a pair of lower sprockets 38A and 38B. Lower sprockets 38A and 38B are mounted onto lower sprocket plates 40A and 40B, which are in turn mounted onto brackets 20F and 20R. Each of lower sprockets 38A and 38B is adapted to rotatably receive a chain 22.

Figure 5:
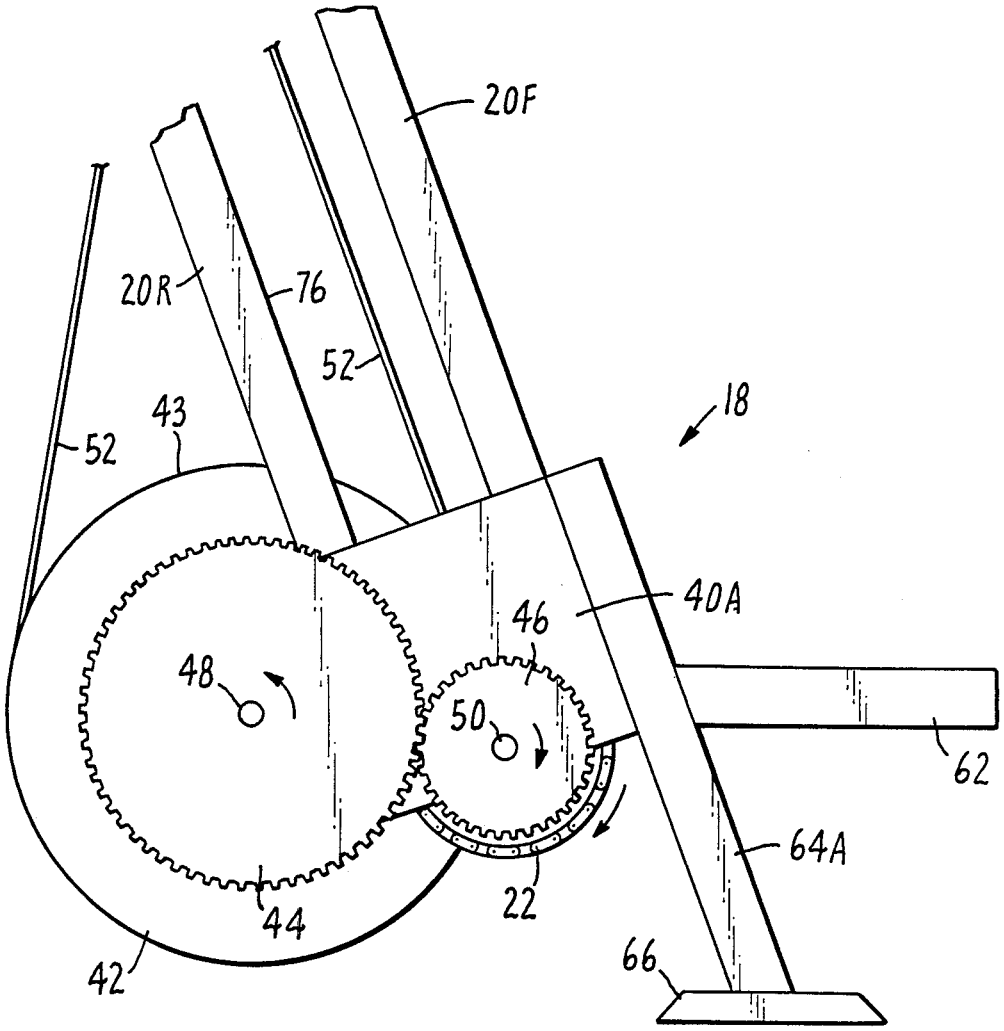
FIG. 5 is an enlarged, side view of the speed regulation means of the exerciser simulator of FIGS. 1–3, with portions broken away.

As best shown in FIGS. 1–3 and 5, speed regulation means 18 comprises braking means, braking gear means, and brake adjustment means. In particular, braking means includes a rotatable brake wheel 42 that has a perimetrical braking surface 43, an endless stretchable brake strap 52 that frictionally contacts braking surface 43, a brake spring 54, and a brake pulley 56. Braking gear means includes a brake gear 44 and a sprocket gear 46. Brake wheel 42 and brake gear 44 are rotatably mounted onto axle 48. As best shown in FIG. 5, brake gear 44 and sprocket 46 are in gearing communication with each other. In turn, sprocket rear 46 is rotatably connected to lower sprockets 38A and 38B via axle 50. Brake adjustment means includes a conventional turnbuckle 58 the operation of which is well within the knowledge of one skilled in the art. As best shown in FIGS. 1–3, a cable 60 is connected at one end to turnbuckle 58 and at the other end to brake spring 54, which in turn is connected to brake strap 52. Cable 60 travels past brake pulley 56.

Exerciser simulator 12 further comprises a foldable safety step 62, a pair of leg members 64A and 64B, which in turn are mounted onto a floor mount 66. In addition, a wall mount 68 is also provided. Wall mount 68 may include a pair of conventional mounting eyelets 70. An upper safety rung 72 is also provided. Moreover, a pair of safety handles are provided, the left one is designated 74 and the right one is in essence turnbuckle 58. Further, a safety wall 76 is mounted across rear brackets 20R. A conventional speedometer/odometer device 78 is provided.

In operation, a pair of chains 22 are provided, with one of the chains 22 travelling within a front bracket 20F, meshing with a lower sprocket 38A, returning through a rear bracket 20R, and meshing with an upper sprocket 34A. The second chain 22 similarly winds through a front bracket 20F, a lower sprocket 38B, a rear bracket 20R, and an upper sprocket 34B. Rung attachment means 24 are provided so as to attach a rung 16 to chains 22.

An operator rotates turnbuckle 58 so as to maintain a tension on cable 60, which in turn maintains a tension on brake strap 52. Brake strap 52 is stretchably mounted to perimetrical braking surface 43 of brake wheel 42, which is rotatably connected to brake gear 44 via axle 48. Meshing with the teeth of brake gear 44 are the teeth Of sprocket gear 46, which is rotatably connected to lower sprockets 38A and 38B via axle 50. In this fashion, the rotation of chains 22 is controlled or regulated by the amount and speed of rotation of sprockets 38A and 38B, which are controlled by speed regulation means 18.

In use, an operator would first stand on safety step 62. His hands are holding onto safety handle 74 and turnbuckle 58. At this juncture the operator rotates turnbuckle 58 to adjust the tension on safety strap 52, which affects the rotation of brake wheel 42. The operator then places one foot onto the lowermost rung 16. If there is insufficient tension on brake wheel 42, i.e., not enough friction between braking surface 43 and braking strap 52, he quickly forces the lowermost rung to the level of safety step 62. Safety step 62, therefore, is provided to prevent injury when there is insufficient tension, causing chains 22 and rungs 16 to travel too fast.

After adjusting turnbuckle 58 to the appropriate tension, the operator, still holding onto safety handle 74 and turnbuckle 58, can then climb up exerciser simulator 12 in a manner similar to climbing a ladder. As the operator steps upward onto an upper, adjacent rung 16, his weight forces rungs 16 and, in turn, chains 22 towards a downward direction. Chains 22 travel in the downward direction when they are entrained in front brackets 20F and in an upward direction in rear brackets 20R. The operator's position with respect to the ground remains relatively stationary. The operator may also climb exerciser simulator 12 by placing his hands on rungs 16, further simulating ladder climbing.

Safety step 62 performs another safety function in that it prevents the feet of the operator from being entangled with lower sprockets 38A and 38B. Vertical wall 76 is another safety feature in that the limbs of the operator cannot be tangled with the upwardly-moving rungs 16 which are traveling between rear bracket 20R.

Figure 6:
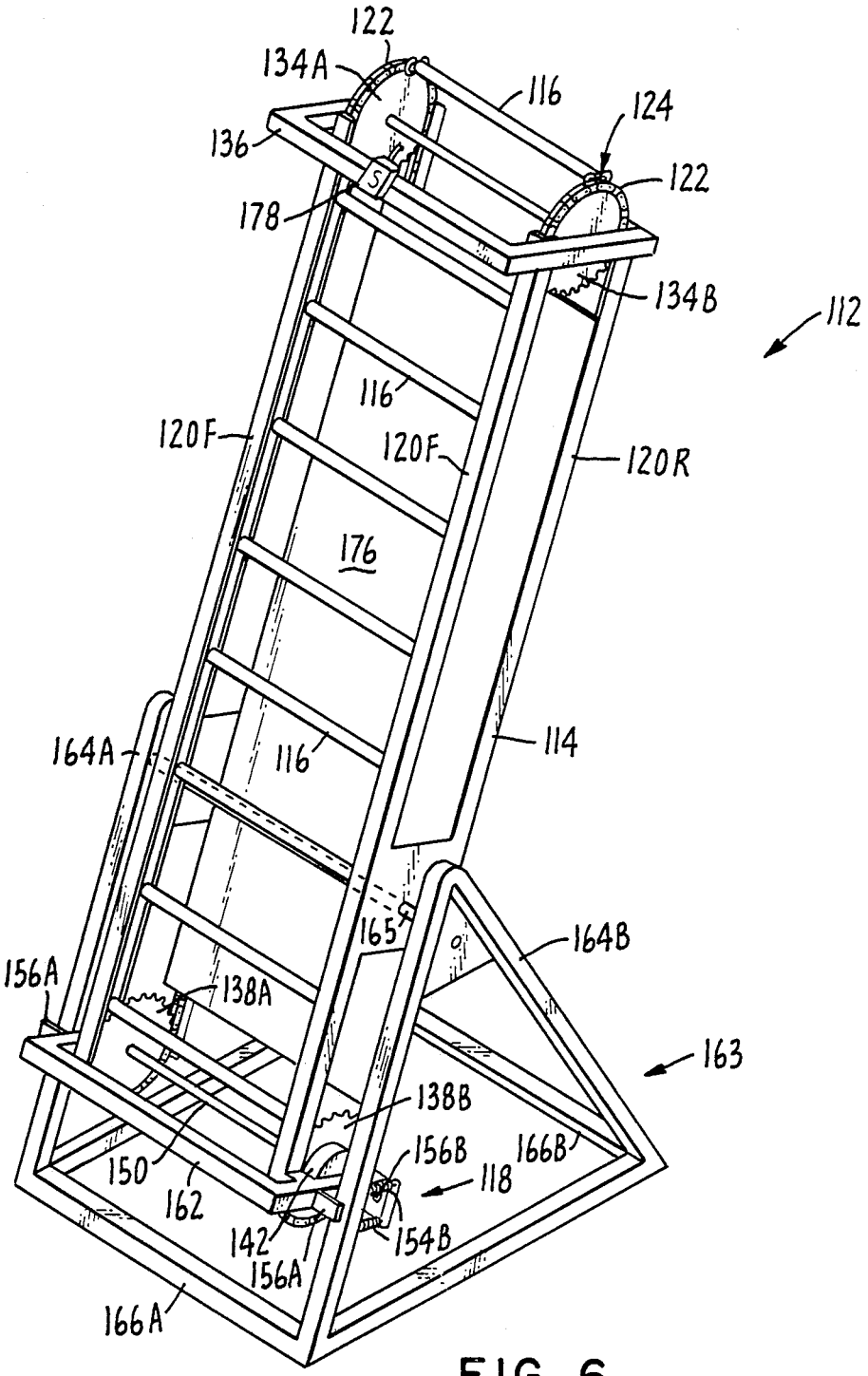
FIG. 6 is a perspective view of an alternative embodiment of the exerciser simulator of FIG. 1.
Figure 7:
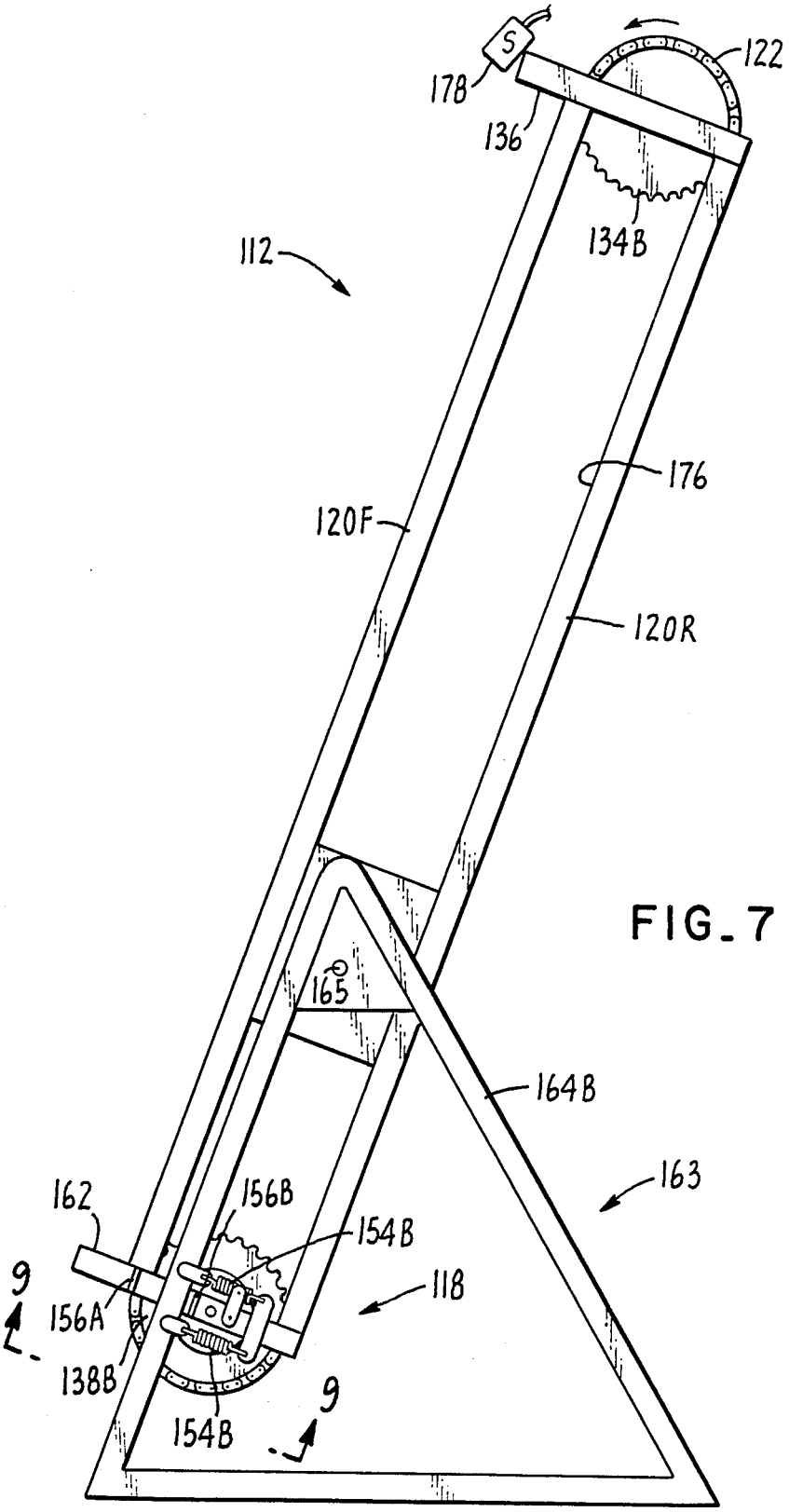
FIG. 7 is a side view of the exerciser simulator of FIG. 6, with portions broken away.
Figure 8:
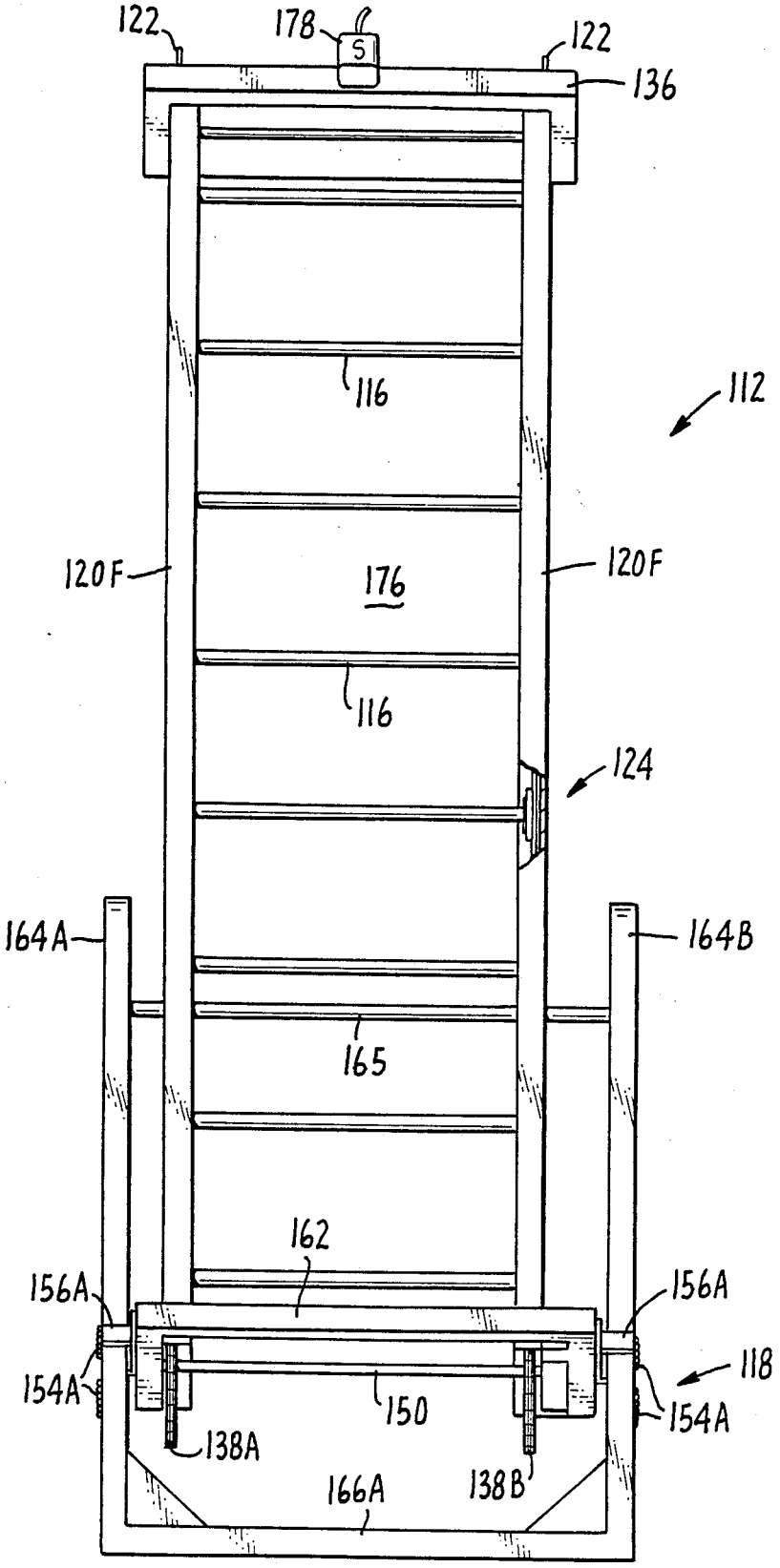
FIG. 8 is a front view of the exerciser simulator of FIG. 6, with portions broken away.

As shown in FIGS. 6–8, there is illustrated an alternative embodiment to exerciser simulator 12, designated 112. Since exerciser simulator 112 includes elements which are identical to their counterparts in simulator 12, a numeral "1" is added to the numerals designating the corresponding elements of simulator 12. In addition, since many of the elements of simulator 112 perform their functions in a manner identical to their counterparts in simulator 12, those elements of simulator 112 will not be further described unless otherwise indicated.

Exerciser simulator 112 comprises generally U-shaped brackets 120F and 120R, defining a frame 114, in which chains 122 travel. In addition, exerciser simulator 112 includes upper sprockets 134A and 134B, and lower sprockets 138A and 138B. Frame 114 is mounted on a triangular floor mount 163, triangular sideframes 164A and 164B, and floor frames 166A and 166B. Triangular sideframes 164A and 164B are connected by axle 165. In addition, frame 114 is rotatably mounted onto frame 163 via axle 165. In addition, simulator 112 includes an upper crossmember 136 and a lower crossmember 162.

Figure 9:
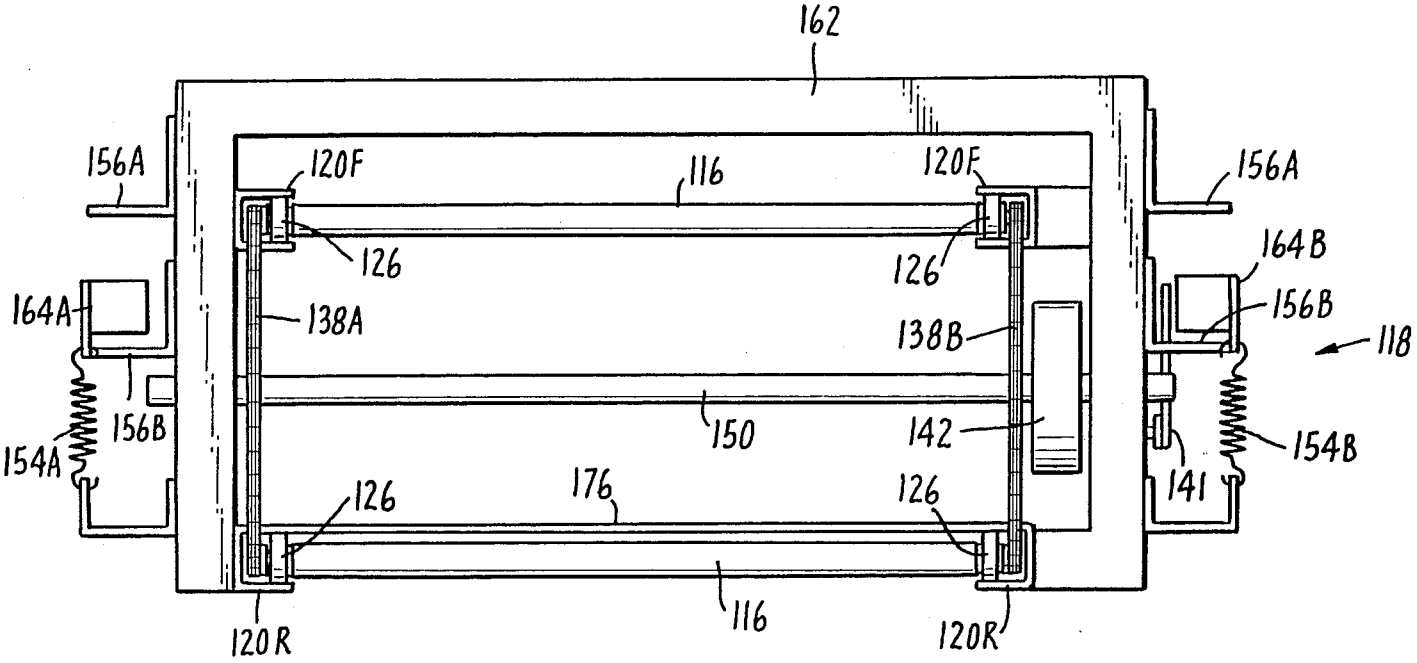
FIG. 9 is an enlarged bottom view of the speed regulation means of the exerciser simulator of FIGS. 6–8, taken along line 9—9 of FIG. 7.
Figure 10B:
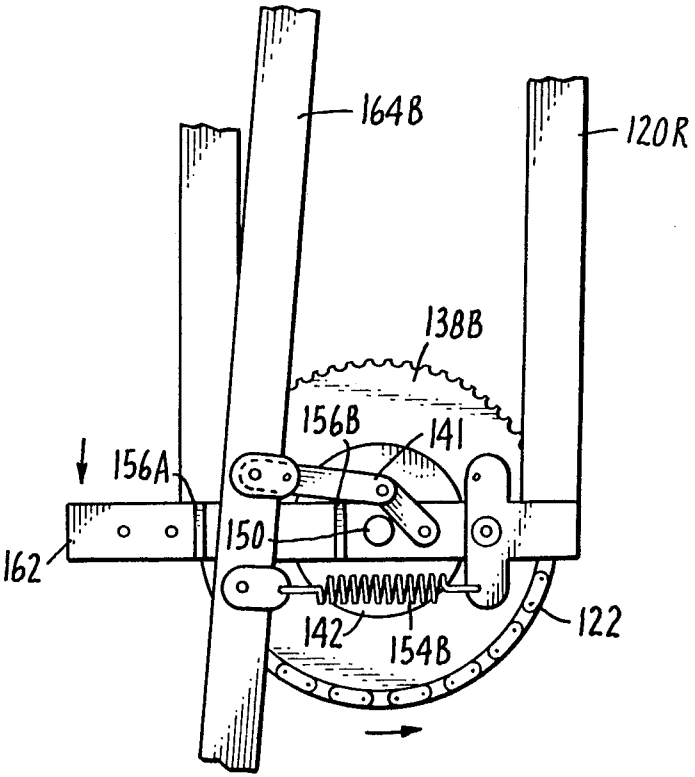
FIGS. 10A and 10B are enlarged, diagrammatical side views of the speed regulation means of the exerciser simulator of FIG. 9, with portions broken away.
Figure 10A:
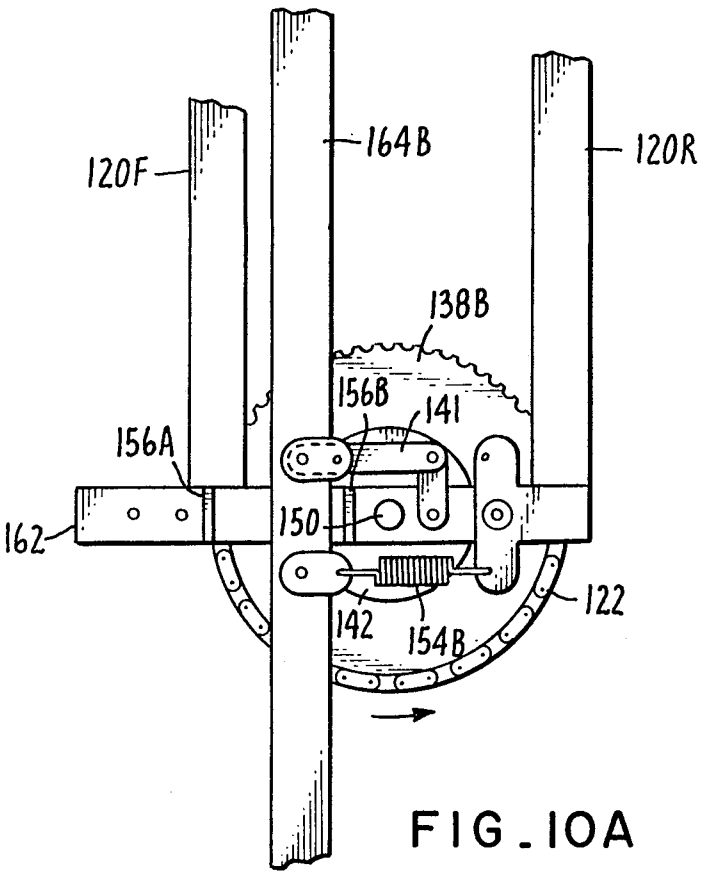

Further, exerciser simulator 112 comprises speed regulation means 118. Speed regulation means 118 includes, as best shown in FIGS. 9, 10A and 10B, a brake arm 141, a conventional drum brake 142, and a plurality of springs 154A and 154B. Drum brake 142 and lower sprockets 138A and 138B are rotatably connected by axle 150. In turn, brake arm 141 is also connected to axle 150. In addition, brake arm 141 is mounted to right triangular mount 164B, as best shown in FIGS. 7, 9, 10A and 10B. A pair of springs 154A connects lower crossmember 162 with left triangular frame 164A, as best shown in FIG. 9, and a pair of springs 154B connects lower crossmember 162 with right triangular frame 164B, as best shown in FIGS. 9, 10A and 10B. Crossmember 162 is provided to activate drum brake 142. Further, speed regulation means 118 includes two pairs of rotation restrain plates 156A and 156B.

In use, as an operator steps onto lower crossmember 162, his weight forces lower crossmember 162 into a downward direction. As best shown in FIG. 10B, this force causes brake arm 141 to rotate, which in turn activates drum brake 142. Drum brake 142 is a conventional drum-type brake the operation of which is well within the knowledge of one skilled in the art. The tightened drum brake 142 stops any rotation of shaft 150 such that lower sprockets 138A and 138B no longer rotate. Thus, chains 122 and their concomitant rungs 116 stop their downward motion. As the operator climbs upward on simulator 112, and especially when his center of gravity passes beyond axle 165 of triangular mount 163, the torque that he exerts on frame 114 decreases. Axle 165 is the fulcrum point of frame 114. Springs 154A and 154B then retract to their positions as shown in FIG. 10A, i.e. releasing the tension on brake arm 141. This in turn releases drum brake 142, permitting chains 122 to rotate on lower sprockets 138A and 138B. Rotation restrain plates 156A and 156B are provided to prevent brackets 120F and 120R from rotating too far from their generally inclined position.

Simulator 112 also includes vertical safety plate 176 and speedometer-odometer device 178.

Figure 11:
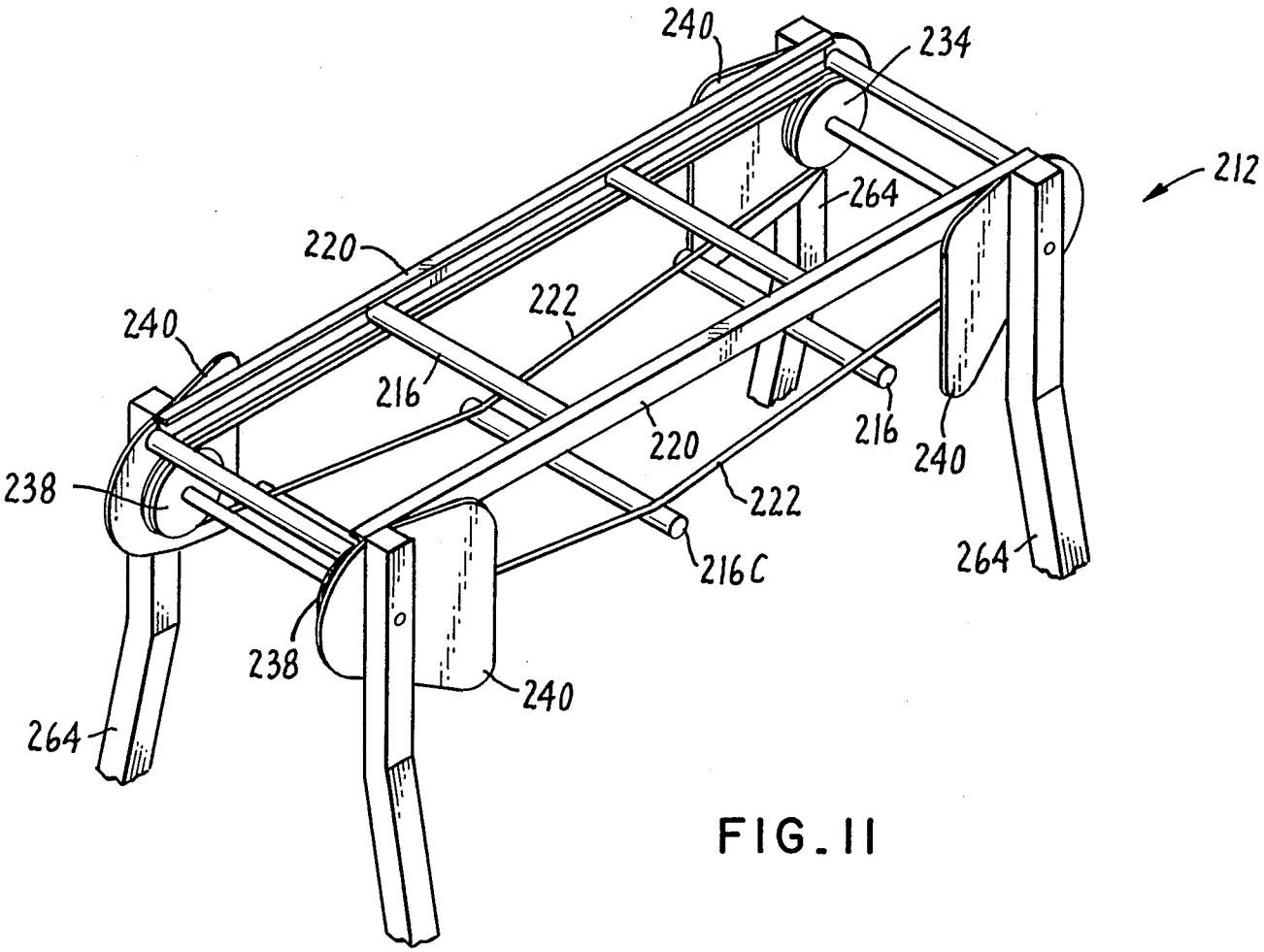
FIG. 11 is a perspective view of another alternative embodiment of the exerciser simulator of FIG. 1, with portions broken away.
Figure 12:
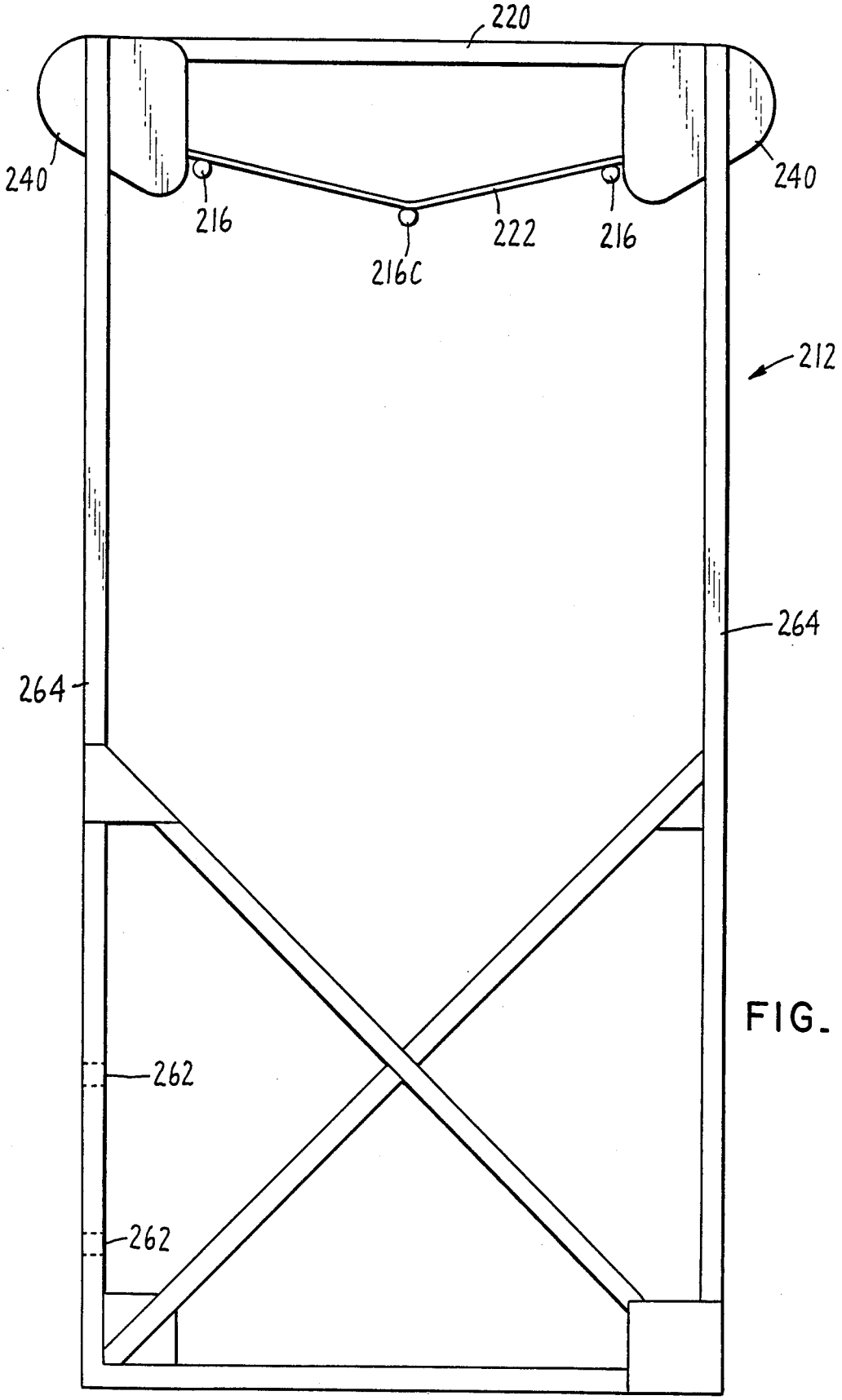
FIG. 12 is a side view of the exerciser simulator of FIG. 11.
Figure 13:
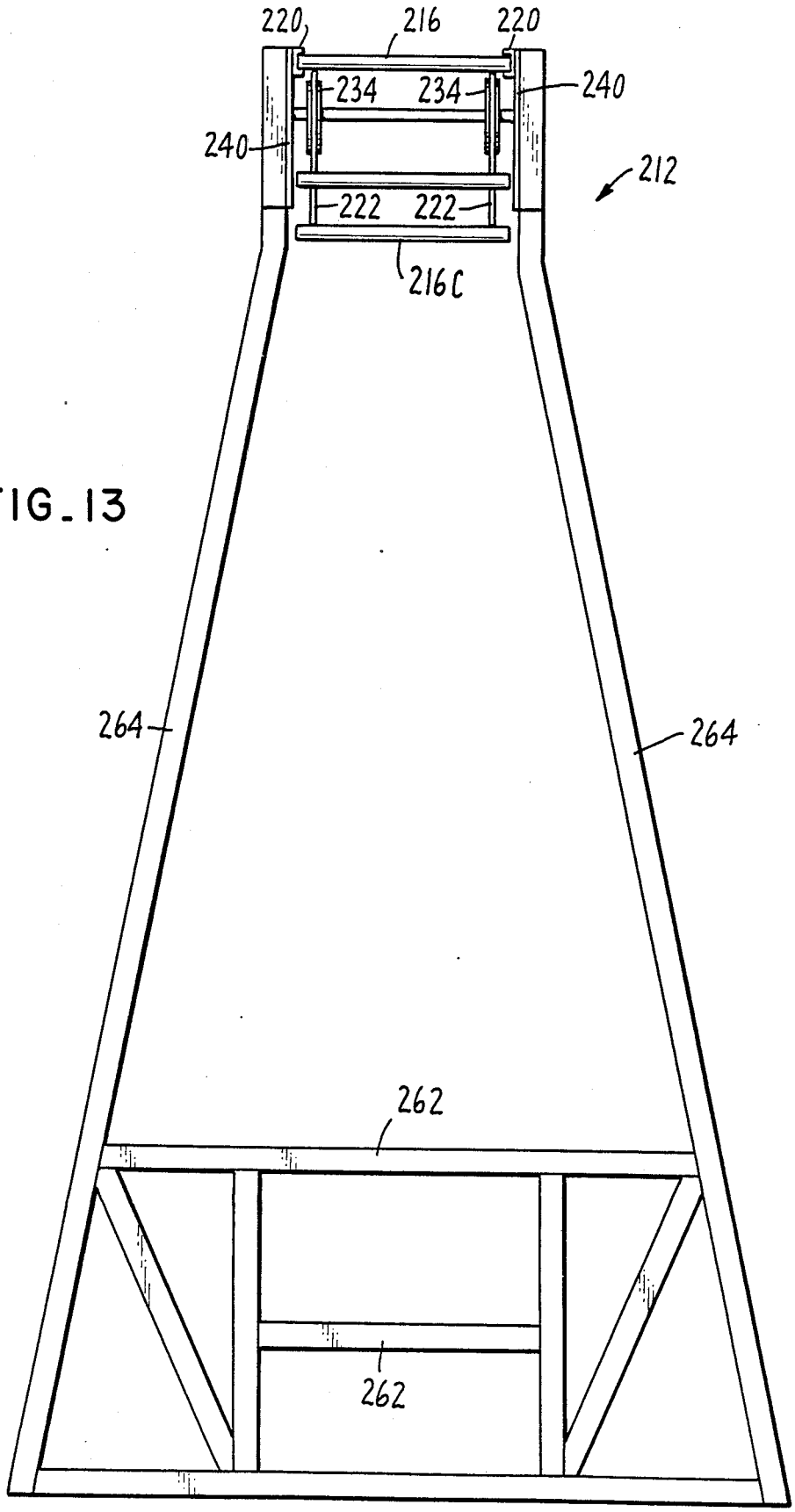
FIG. 13 is a front view of the exerciser simulator of FIG. 11.
Figure 14:
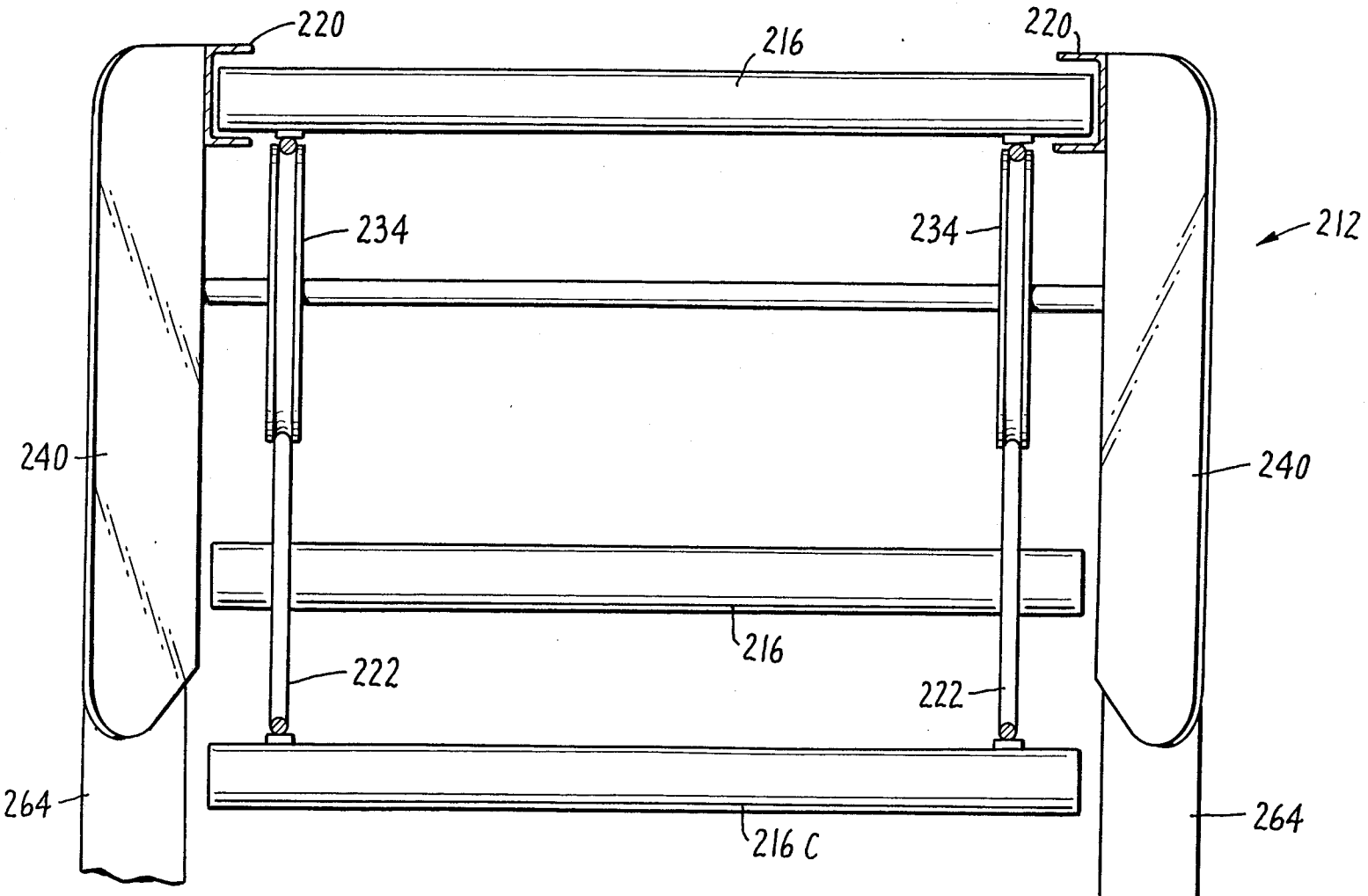
FIG. 14 is an enlarged view of the exerciser simulator of FIG. 13, with portions broken away.

As best shown in FIGS. 11–13, there is illustrated a third embodiment of an exerciser simulator, designated 212. In particular, simulator 212 comprises four leg members 264 which are positioned vertically to a ground surface, not shown; a pair of generally U-shaped brackets 220; and a plurality of bars 216 which travel between brackets 220. Brackets 220 are positioned parallel to the ground surface. In addition, simulator 212 includes two pairs of grooved wheels 234 and 238 in which ropes 222 travel. Bars 216 are attached in a manner that is normal to ropes 222. Flared guides 240 are provided adjacent to each of the grooved wheels 234 and 238.

In use, an operator steps onto crossmembers 262, as best shown in FIGS. 12–13, and uses his hands to grip onto the closest bar 216. He then advances towards the center, and also the lowermost bar 216C. As the operator grabs onto the next bar 216, he pulls that bar 216 to the lowermost center position, i.e., forcing that bar to become bar 216C. Thus, as the operator swings from one bar 216 to the next, ropes 222 rotate about grooved wheels 234 and 238 such that the relative position of the operator stays substantially the same, i.e., dangling beneath lowermost bar 216C.

Figure 15:
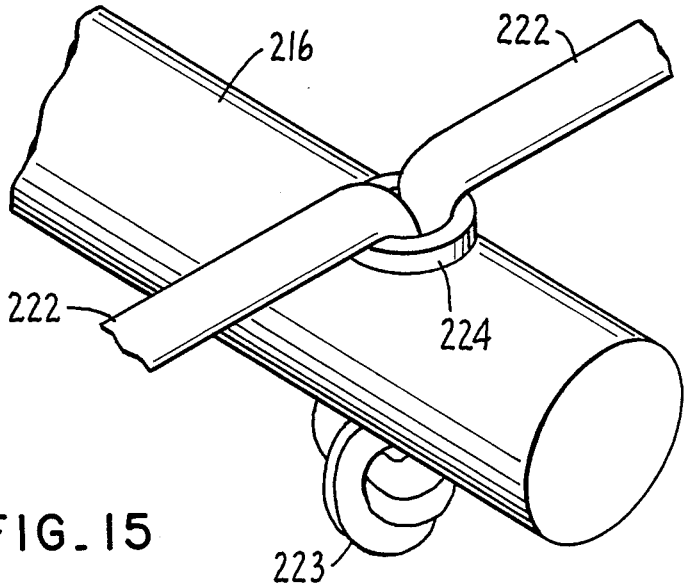
FIG. 15 is an enlarged, perspective view of the rope securement means of the exerciser simulator of FIGS. 11–14, with portions broken away.

As best shown in FIG. 15, at the outer ends of each bar 216, there is a radial hole, not shown, through which rope 222 is inserted. At the exit end of the hole, rope 222 is tied into a knot 223 so as to secure the rope. An annular ring 224 is provided at the entry of the hole.

Simulator 212 may be positioned such that one end of the apparatus, e.g., the end that has grooved wheels 234, is slightly elevated to further simulate this arduous arm-swinging exercise.

Figure 16:
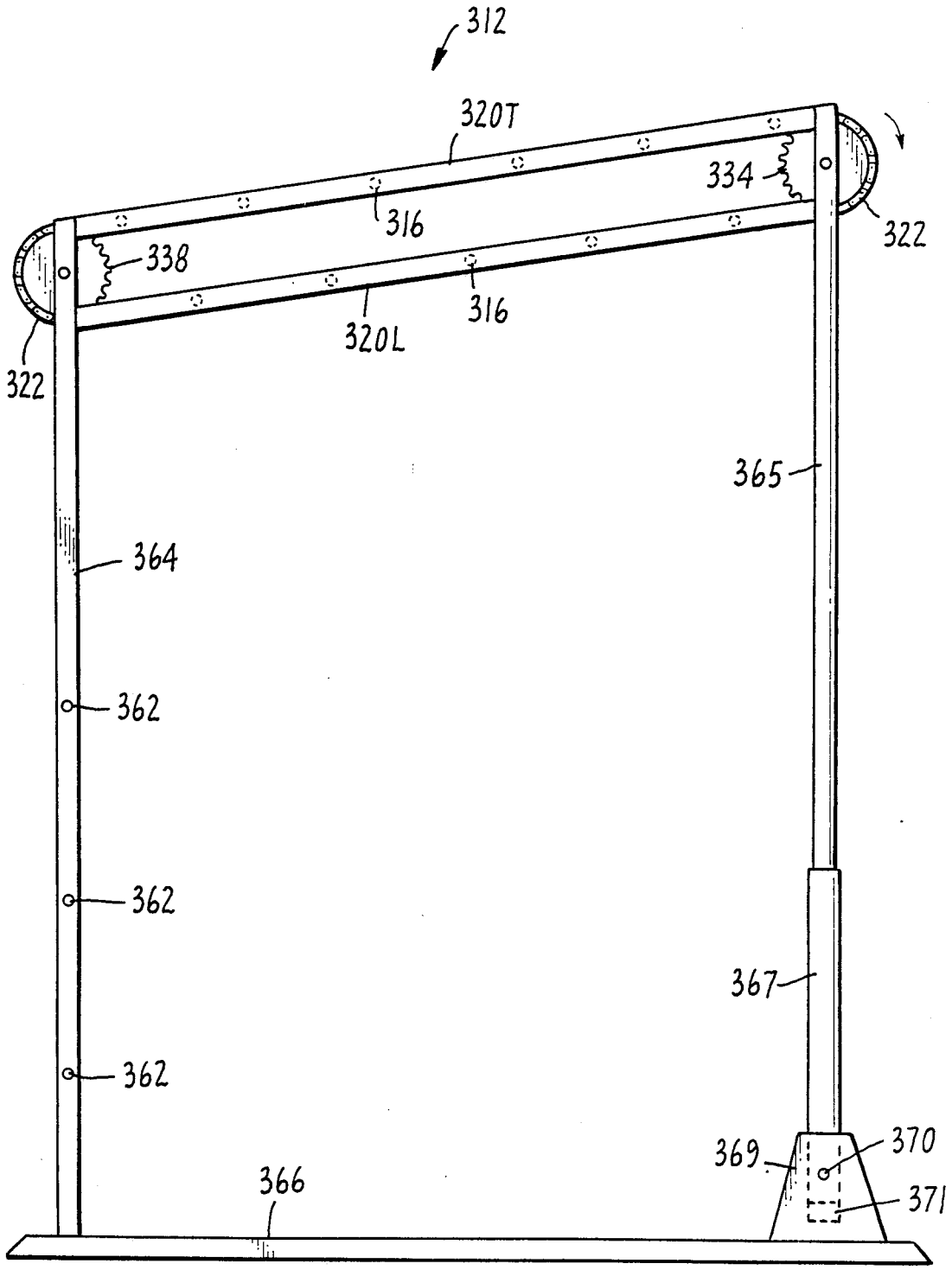
FIG. 16 is a side view of a further embodiment of the exerciser simulator of FIG. 1.
Figure 17:
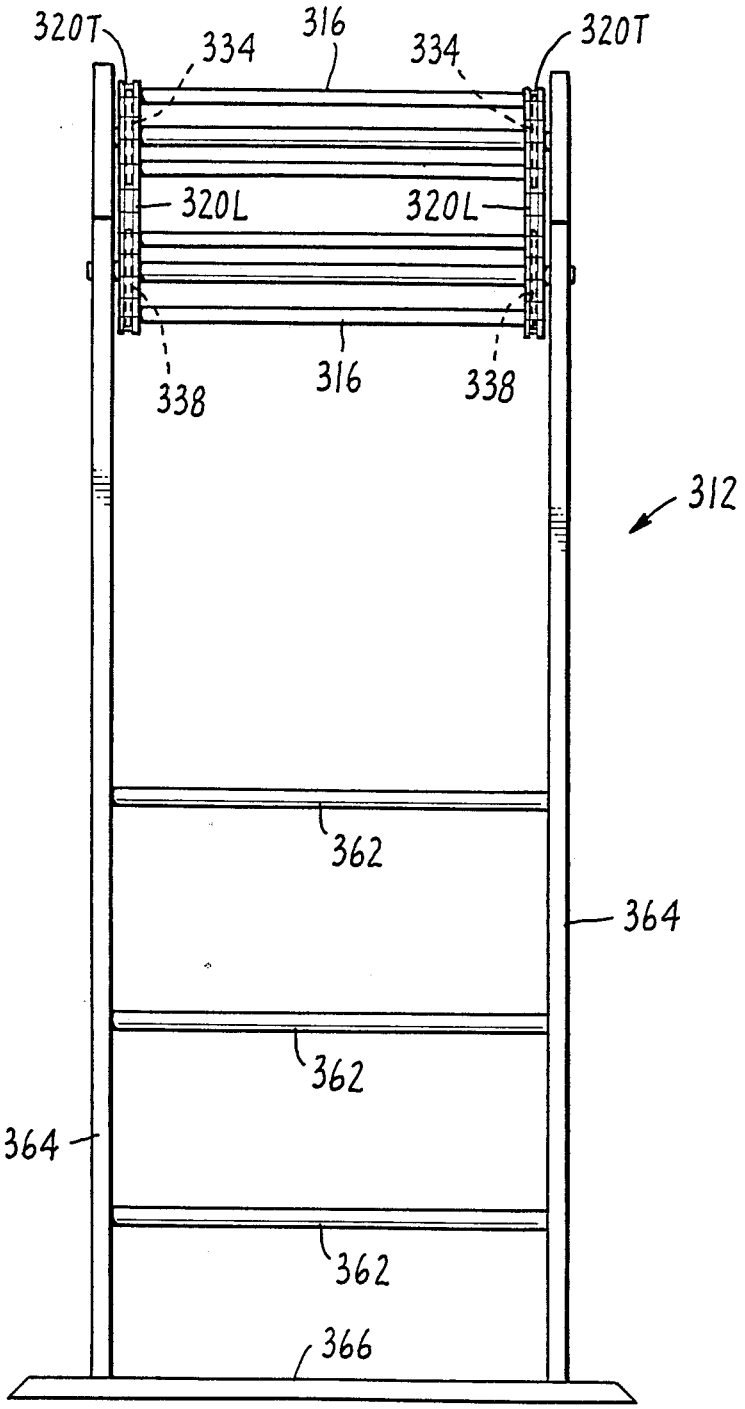
FIG. 17 is a front view of the exerciser simulator of FIG. 16.
Figure 18:
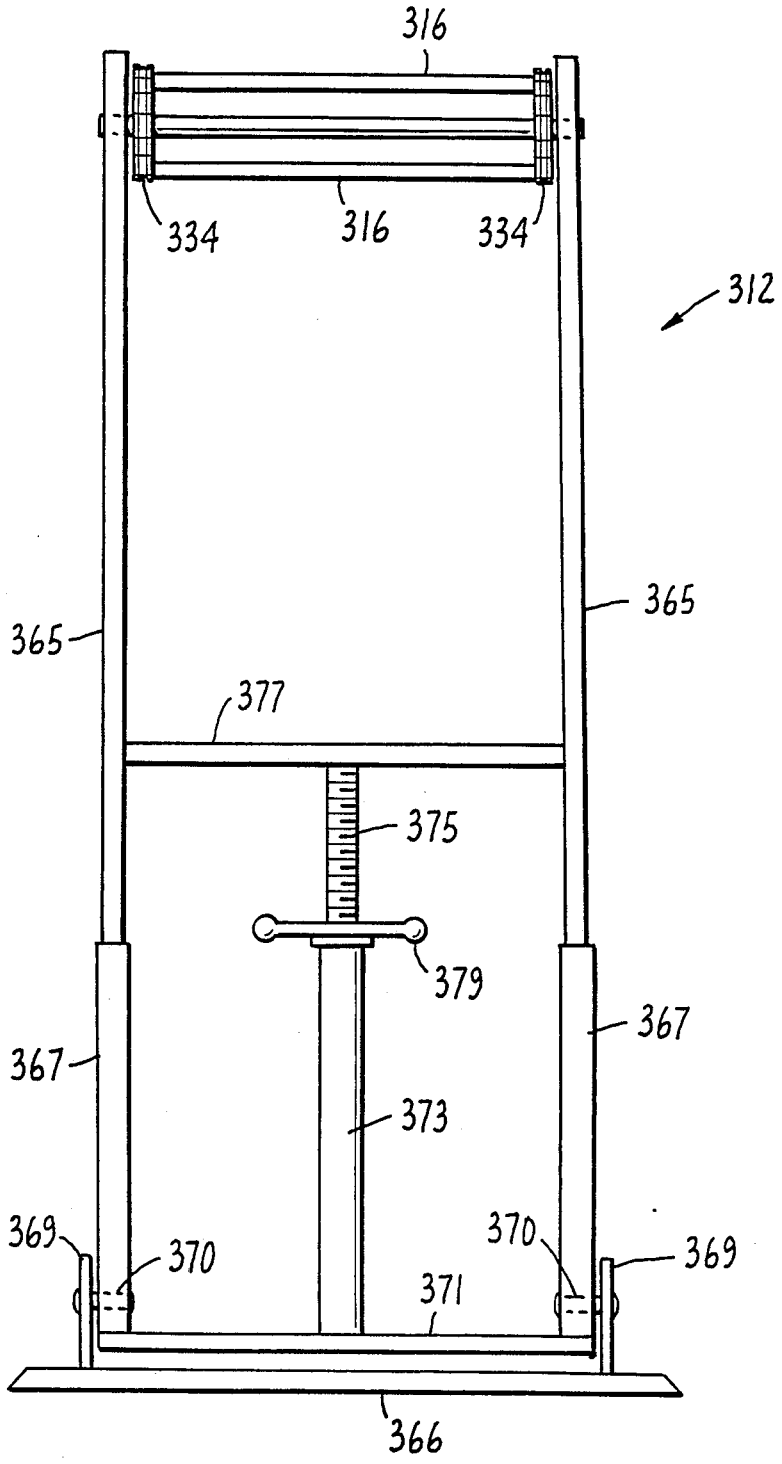
FIG. 18 is a rear view of the exerciser simulator of FIG. 16.

A further embodiment of an exerciser simulator, designated 312, is illustrated in FIGS. 16–18. Simulator 312 comprises a pair of front legs 364 and a pair of rear legs 365, which are positioned vertically to a ground surface. Rotatably mounted at the top portion of front legs 364 is a pair of front sprockets 338, and rotatably mounted at the top portions of rear legs 365 is a pair of rear sprockets 334. In addition, mounted between front legs 364 and rear legs 365 are a pair of top brackets 320T and a pair of lower brackets 320L. Brackets 320T and 320L are positioned parallel to the ground surface. As best shown in FIG. 16, brackets 320T and 320L in the preferred embodiment are positioned with one of their ends higher than the other. Travelling within each pair of top brackets 320T and lower brackets 320L, and enmeshing with one front sprocket 338 and one rear sprocket 334, is a chain 322. A similar chain 322 travels through another pair of top brackets 320T and lower brackets 320L and sprockets 338 and 334. Mounted in a horizontal fashion across the pair of chains 322 are a plurality of bars 316. Bars 316 are mounted to chains 322 by bar attachment means 324. Since exerciser simulator 312 includes elements which are identical to their counterparts in simulators 12, 112 and 212, the corresponding elements of simulator 312 will not be described in great detail.

More particularly, mounted across front legs 364 are a plurality of crossmembers 362. Rear legs 365 in the preferred embodiment are support pipes which are received within larger base pipes 367, which in turn are pivotally mounted to brackets 369. Cross bolts 370 are provided for mounting base pipes 367 to brackets 369. Mounting brackets 369 and front legs 364 are mounted onto a base 366. As best shown in FIG. 18, positioned at the lower portion of rear legs 367 is a crossmember 371, which in turn is connected to a vertical member 373. Threaded into vertical shaft 373 is threaded member 375. In turn threaded member 375 is connected to upper crossmember 377, which in turn connects rear legs 365. Threaded member 375 is raised and lowered by a control wheel 379.

In use, control wheel 379 is rotated by an operator so as to raise or lower rear legs 365 to an appropriate position. Preferably, rear legs 365 are raised to a position that is higher in elevation than front legs 364 such that chains 322 travel in an incline position, as best shown in FIG. 16. The extension and retraction of rear legs 365 cause base pipes 367 to pivot about cross bolts 370. As an operator ascends crossmembers 362 of front legs 364, as best shown in FIG. 17, he grabs the closest bar 316 that is positioned between lower brackets 320L. As the operator advances toward the next bar 316, his weight causes chain 322 to rotate about sprockets 334 and 338. In this fashion, the operator is attempting to advance toward rear legs 365. Due to the rotation of bars 316 toward the front legs 364, the relative position of the operator is essentially stationary. Simulator 312, thus, simulates an arm-swinging exercise.

It will be apparent to those skilled in the art that various modifications may be made within the spirit of the invention and the scope of the appended claims.

We claim:

1. An exerciser simulator, comprising:

a base having fulcrum point;

at least two generally concave members defining a frame, each of said concave members having a first end and a second end, said frame being rotatably mounted on the base at the fulcrum point;

a rotatable member positioned adjacent to each of said first and second ends of each of said concave members;

a unidirectional, closed-looped transporting chain travelling adjacent to each of said concave members, said transporting chain being rotatably received by said first end rotatable member and said second end rotatable member for travelling towards a direction defined by one of said first and second ends of each of said concave members;

a plurality of exercise bars each of which is fixably mounted to both said transporting chains, said exercise bars being mounted generally normal to said transporting chains at a preselected positions of said transporting chains and each of said exercise bars having two mounting means for securely mounting each of said exercise bars to said transporting chains; and speed regulation means mounted between the base and the frame for controlling the speed of travel of said transporting chains, whereby the weight of a user initially causes engagement of the speed regulation means to prevent movement of said transporting chains, and as the user advances on said exercise bars beyond said fulcrum point towards a direction opposite to said defined direction the speed regulation means becomes disengaged causing said transporting chains and said attached exercise bars to travel towards said defined direction, thereby simulating a climbing exercise.

2. The exerciser simulator as claimed in claim 1, wherein said bar mounting means comprises at least one mounting plate that is mounted to both said exercise bar and said transporting chain; and at least one roller that is rotatably mounted to said mounting plate, said roller being adapted to rotate within said concave member.

3. The exerciser simulator as claimed in claim 1 or 2, wherein said speed regulation means comprises:

a drum brake, mounted to said frame, that is rotatably connected to said rotatable member; and brake activation means, rotatably connected to said drum brake, for activating said drum brake so as to stop said travel of said transporting chains, whereby the combined effect of the release of said drum activation means and the crossing of said fulcrum point by the user activates the rotation of said transporting chains.

4. The exercise simulator as claimed in claim 3, wherein said speed regulation means further comprises:

a spring, connected to both said base and said brake activation means, for biasing said brake activation means towards the inactive state.

5. An exerciser simulator, comprising:

a base having a fulcrum point;

at least two generally U-shaped bracket members defining a frame, each of said bracket members having an upper and a lower end, said frame being rotatably mounted on the base at the fulcrum point;

a rotatable sprocket positioned adjacent to each of said upper and lower ends of each of said bracket members;

a unidirectional, close-looped transporting chain travelling within each of said bracket members, said transporting chain being rotatably received by said upper end rotatable sprocket and said lower end rotatable sprocket for travelling towards said lower end of each of said bracket members;

a plurality of exercise bars each of which is fixably mounted to both said transporting chains, said exercise bars being mounted generally normal to said transporting chains at preselected positions of said transporting chains and each of said exercise bars having two mounting means for securely mounting each of said exercise bars to said transporting chains; and speed regulation means mounted to said frame for controlling the speed of travel of said transporting chains, wherein said seed regulation means comprises a drum brake, mounted to said frame, that is rotatably connected to one of said lower sprockets;

brake activation means, rotatably connected to said drum brake, for activating said drum brake so as to stop said travel of said transporting chains; and a spring, connected to both said base and said brake activation means, for biasing said brake activation means toward an inactive state, whereby the combined effect of the release of said drum activation means and the crossing of said fulcrum point by the user activates the rotation of said transporting chains, whereby the weight of a user initially causes engagement of the speed regulation means to prevent movement of said transporting chains, and as the user advances on said exercise bars beyond said fulcrum point towards a direction opposite to said defined direction the speed regulation means becomes disengaged causing said transporting chains and said attached exercise bars to travel towards said lower ends of said bracket members, thereby simulating a climbing exercise.

6. The exerciser simulator as claimed in claim 5, wherein said bar mounting means comprises two parallel mounting plates which are mounted to both said exercise bar and said transporting chain; and at least one roller that is rotatably mounted to said mounting plates, said roller being adapted to rotate within said bracket member.

* * * * *

UNITED STATES PATENT AND TRADEMARK OFFICE

CERTIFICATE OF CORRECTION

PATENT NO. : 4,822,029

DATED : April 18, 1989

INVENTOR(S) : G. G. Sarno, et al.

It is certified that error appears in the above - identified patent and that said Letters Patent is hereby corrected as shown below:

In the Abstract, line 17, delete the word "exerise" and substitute --exercise--;

In Col. 3, line 49, delete the word "rear" and substitute --gear--;

In Col. 4, line 16, delete the word "Of" and substitute --of--;

In Col. 8, line 31, delete the word "seed" and insert --speed--.

Signed and Sealed this

Seventeenth Day of April, 1990

*Attest:*

HARRY F. MANBECK, JR.

*Attesting Officer*

*Commissioner of Patents and Trademarks*